US007178371B2

(12) United States Patent
Lindström

(10) Patent No.: US 7,178,371 B2
(45) Date of Patent: Feb. 20, 2007

(54) DISC TUMBLER LOCK

(75) Inventor: Marko Lindström, Björkboda (FI)

(73) Assignee: Bjorkboda Las Oy AB, Bjorkboda (FI)

( * ) Notice: Subject to any disclaimer, the term of this patent is extended or adjusted under 35 U.S.C. 154(b) by 71 days.

(21) Appl. No.: 10/509,005

(22) PCT Filed: Mar. 14, 2003

(86) PCT No.: PCT/FI03/00196

§ 371 (c)(1),
(2), (4) Date: Oct. 15, 2004

(87) PCT Pub. No.: WO03/080969

PCT Pub. Date: Oct. 2, 2003

(65) Prior Publication Data

US 2005/0126237 A1 Jun. 16, 2005

(30) Foreign Application Priority Data

Mar. 27, 2002 (FI) ..... 20020587

(51) Int. Cl.
*E05B 21/00* (2006.01)

(52) U.S. Cl. ..... 70/134; 70/352; 70/355

(58) Field of Classification Search ..... 70/134, 70/81, 348–355
See application file for complete search history.

(56) References Cited

U.S. PATENT DOCUMENTS 2,617,289 A * 11/1952 Shann ..... 70/338
3,762,192 A * 10/1973 Errani ..... 70/352
3,879,968 A * 4/1975 Schweizer et al. ..... 70/81

FOREIGN PATENT DOCUMENTS

| | | |
|---|---|---|
| EP | 0 903 455 | 3/1999 |
| GB | 386502 | 1/1933 |
| GB | 1 374 288 | 11/1974 |

* cited by examiner

*Primary Examiner*—Lloyd A. Gall
(74) *Attorney, Agent, or Firm*—Smith-Hill and Bedell

(57) ABSTRACT

A disc tumbler lock, which comprises a lock case, which includes a bolt displaceable with a key of the lock and a number of locking discs provided with locking channels and which are displaceable with the key of the lock against the force of a spring to open the lock and for guiding the movements of which the lock case is provided with stationary guiding members, and a locking pin dependent on the movements of the bolt and which is arranged to cooperate with the locking channels of the locking discs. At least one of the locking discs is equipped with gripping structure, which, when the bolt is pressed inwards to the lock case, are arranged to cooperate with counter structure arranged in the lock case for preventing the displacement of the at least one locking disc. Further, the at least one locking disc is spring-loaded to turn the locking disc around a first guiding member against a second guiding member so that the second guiding member guides the at least one locking disc substantially towards the head of the bolt to be protruded out from the lock case.

10 Claims, 2 Drawing Sheets

DISC TUMBLER LOCK

Figure 1:
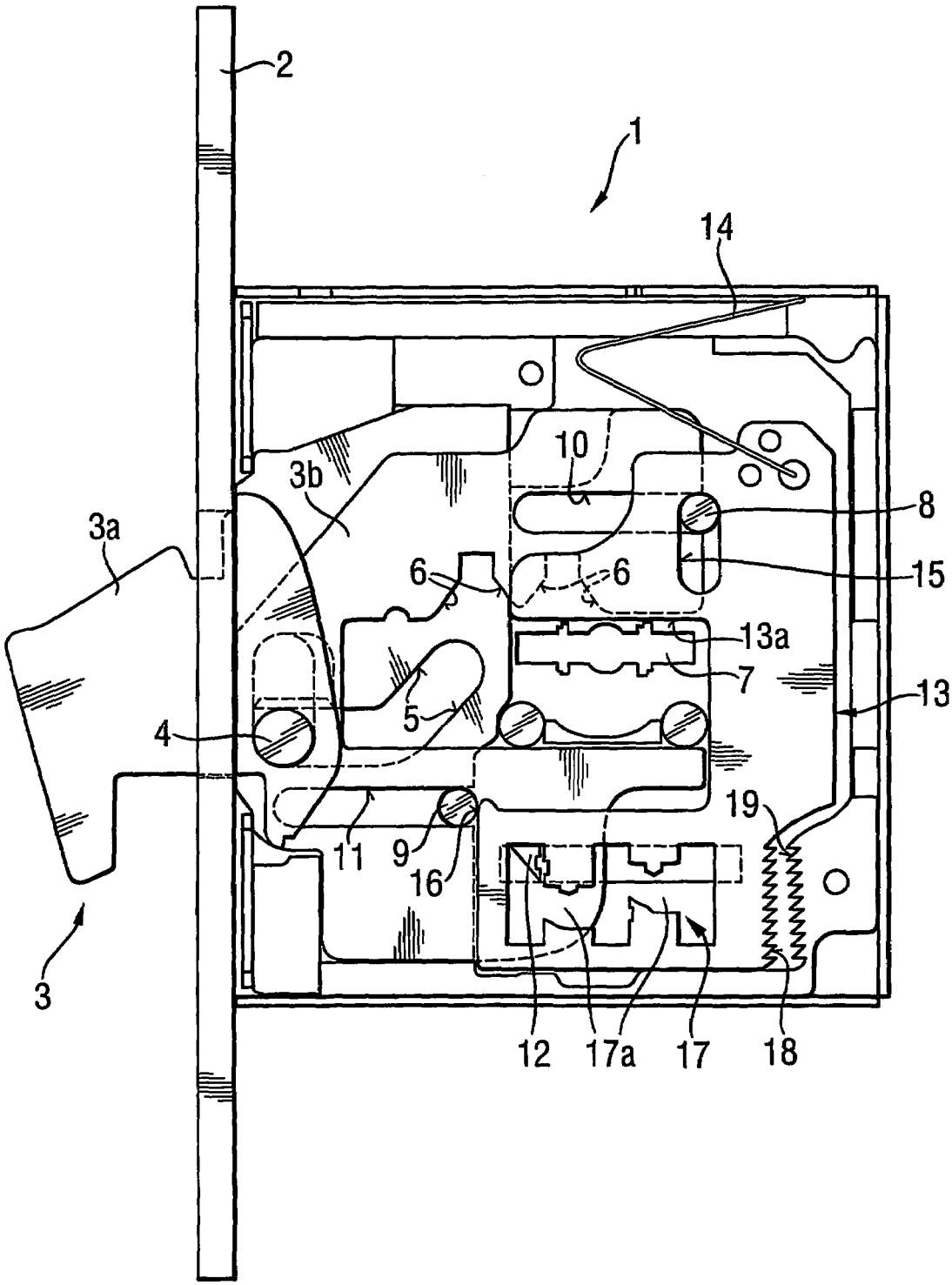

This is a national stage application filed under 35 USC 371 based on International Application No. PCT/FI2003/00196 filed Mar. 14, 2003, and claims priority under 35 USC 119 of Finnish Patent Application No. 20020587 filed Mar. 27, 2002.

The invention relates to a disc tumbler lock.

In addition to durability and reliability of operation, one desirable feature of locks is that they should be practically unpickable or picking the lock would be at least as difficult as possible. A known method, by which the lock type being object of the invention has been tried to be picked, is based on the fact that the lock bolt is pushed inwards to the lock, whereby the locking pin is pressed against the edge of the locking channel of the locking disc preventing movement of the bolt. If the locking disc is then lifted through the keyhole, the location of the locking channel branch of the locking disc permitting displacement of the bolt into the lock case can be probed. By repeating the operation for the part of each locking disc the positions of locking discs permitting opening of the lock can be detected and the lock can be opened.

To prevent picking in the way described above it is known to provide the locking channels with different notches or hooks, into which the locking pin may grip when one tries to detect the right position of the locking discs. A newer solution is disclosed in the publication EP 0 903 455. In this solution, the gripping means are, instead of the locking channel, being arranged to the outer edge of the locking discs so that in a picklocking situation they cooperate with a separate gripping member arranged in the lock case. This means that the guidance for the movement of the locking discs allows the movement caused by pressing in the bolt, as a result of which the said gripping means come into contact with each other. In the disclosed solution, the movement of the locking discs is guided by two pins, which are arranged in guiding grooves in the locking discs. One of these pins is supported to the lock case in a stationary manner and the other in a displaceable manner. The solution is complicated and the entire structure disadvantageous from the viewpoint of manufacturing and assembling.

An aim of the invention is to provide a new improved disc tumbler lock, of which the deficiencies appearing in the disclosed known solution are essentially eliminated. To be more precise, an aim of the invention is to provide a disc tumbler lock, which has excellent properties for resisting picklocking, the structure of which is as simple and reliable as possible and the manufacturing and assembling of which may be carried out more advantageously than before.

The invention is known of the combination that at least one of the locking discs is equipped, in a manner known per se, with gripping means, which, when the bolt is pressed inwards to the lock case, are arranged to cooperate with counter means arranged in the lock case for preventing the displacing of said at least one locking disc, and that the said at least one locking disc is spring-loaded to turn the locking disc around a first guiding member against a second guiding member so that the said second guiding member guides the said at least one locking disc substantially towards the head of the bolt to be pushed out from the lock case.

According to the invention, the guiding members of the locking discs are firmly and reliably secured to the lock case, but the second guiding member is arranged to support the spring-loaded locking discs in a normal situation substantially only in the direction outwards from the lock case. The solution makes it possible to use simple structural elements and provides flexibility for the locking discs in the direction inwards the lock case against the spring-load in question, which is needed for preventing picklocking.

An advantageous solution is obtained if the spring turning the locking disc is a return spring for the locking disc. Hereby the number of required structural components can be minimized.

The counter means arranged in the lock case advantageously comprise one or more gripping members provided at the bottom of the lock case. These may be provided already in the manufacturing stage of the structural elements and no separate installation measures are needed for them.

Furthermore, the said second guiding member can advantageously be arranged to guide also the reciprocating motions of the bolt out from the lock case and into the lock case, which secures guiding of the bolt and further enables to minimize the number of components required.

The locking pin and the locking channels of the locking discs are preferably arranged in the direction transversal with respect to the bolt's direction of displacement at the same position as the said gripping means and the counter means thereof. In this way it can be secured that the locking pin, as a result of the inward pushing movement exerted at the head of the bolt, presses the locking discs correspondingly so that the gripping members engage each other.

Figure 2:
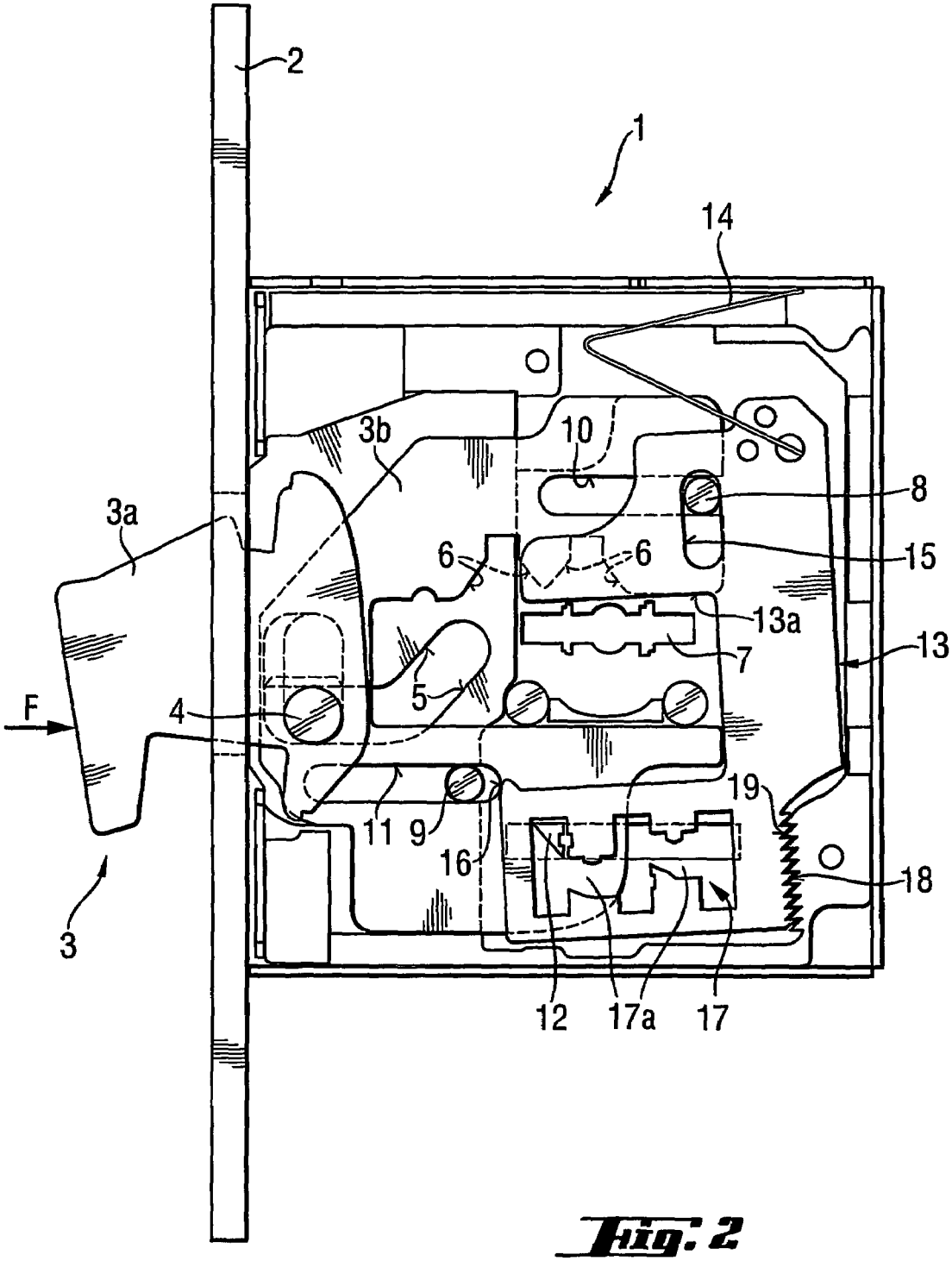

The invention will be described below, as a way of example, with reference to the accompanying drawings, in which:

FIG. 1 shows an embodiment of a disc tumbler lock according to the invention viewed from the side and the lock case opened in a normal situation the bolt protruding, and FIG. 2 shows the lock of FIG. 1 in a picklocking situation when a force is exerted at the head of the bolt pushing the bolt inwards the lock case.

In the drawings the reference number 1 refers to a lock case, which comprises a front plate 2. The lock case includes a keyhole 7 as well as a bolt 3 movable to-and-fro through an opening in the front plate by means of a key of the lock (not shown). The displacement of the bolt takes place through guiding surfaces 6. In the embodiment of the figures, the bolt is a so-called hook bolt, which includes a bolt body 3*b*, displaceable inside the lock case, in which a hook part 3*a* is turnably supported by means of a pin 4. The lock case includes a guiding groove 5 for the pin 4 in order to guide the movements of the hook part 3*a*. The operation of the hook bolt 3 as such is apparent from the publication WO 02/16716 A1. The hook bolt lock is one advantageous embodiment of the invention, but the invention is by no means limited to disc tumbler locks provided with hook bolts, but the invention can be applied as well to disc tumbler locks provided with other bolt types such as dead bolts.

The lock case 1 is provided with a number of locking discs 13, which, in a manner known per se, are separated from each other by intermediate discs (only partly shown). The locking discs are equipped with a locking channel 17, which cooperates with a locking pin 12 secured to the bolt, and with a guiding surface 13*a*, that can be affected with a key of the lock to displace the locking discs upwards in the figures against the force of return springs 14 of the locking discs. The purpose of this displacing movement is to arrange the locking discs 13 so that the locking pin 12 is located in each of the selecting situations at the position of transversal branches 17*a* of the locking channel, whereby the bolt may be moved from a protruding position inwards to open the lock or from a retracted position outwards in order to lock the lock.

The lock case includes guiding members i.e. in this case guiding pins 8 and 9, which are arranged to guide the movements of the bolt via guiding grooves 10 and 11 arranged for the bolt. At the same time, the guiding pins 8 and 9 are arranged to guide also the movements of the locking discs 13. For this purpose, the locking discs comprise a guiding groove 15, which is in cooperation with the guiding pin 8, and a guiding surface 16, which in a normal situation is pressed by the springs 14 in cooperation with the guiding pin 9. The locking discs further comprise gripping members 18 and the lock case includes gripping members 19, which in a certain picklocking situation of the lock are arranged to cooperate with each other as described below in more detail.

The FIG. 2 shows more precisely the operation of the solution according to the invention in a picklocking situation, when a force F is exerted at the bolt's 3 head pushing the bolt inwards. As a result, the locking pin 12 presses the locking discs 13 against the force of the springs 14 via the counter surfaces of the locking channels transversal with respect to the direction of movement of the bolt. Consequently, the locking discs turn around the guiding pin 8 so that the gripping members 18 and 19 grip to each other and thus prevent the displacement of the locking discs through the key hole 7 aimed to probe the right position for opening the lock.

The springs 14 of the locking discs have in this case a double function, on the one hand they keep the locking discs normally in disorder, whereby the locking discs prevent the displacing of the bolt without the right key for the lock and, on the other hand, they urge the locking discs against the guiding pin 9 so that the gripping members 18 and 19 normally stay apart from each other and allow the displacement of the locking discs with the key of the lock in order to open the lock. From the viewpoint of the operation of the invention it is thus essential and sufficient that the locking discs have such a guiding surface 16, which cooperates with the guiding pin in the direction towards the bolt head to be protruded, but allows the displacement in the opposite direction.

It is clear that the gripping members 18 and 19 may be implemented in many different ways. In the solution of the figures, the gripping members 19 may advantageously be arranged directly to the lock case during its manufacturing phase e.g. by pressure moulding or by punching. Also, the location of the gripping members in the lock can be changed. Likewise, when needed, the mutual role of the guiding pins 8 and 9 can be changed, as long as at the same time the placing and functioning of the springs 14 and the functional preconditions of other parts of the lock are taken into consideration.

The invention is thus not limited to the above-described embodiment, but several modifications are conceivable within the scope of the appended claims.

The invention claimed is:

1. A disc tumbler lock comprising:

a lock case, a first gripping structure provided stationarily in the lock case, a bolt that is located at least partially within the lock case and is displaceable relative to the lock case by a key of the lock in an opening direction from a first position in which a head of the bolt protrudes from the lock case to a second position in which the head of the bolt is at least partially retracted relative to the first position of the bolt, a plurality of locking discs each formed with a locking channel, the locking discs being displaceable by the key of the lock against a spring force from a locked position to an open position to open the lock, a locking pin dependent on movement of the bolt and cooperating with the locking channels of the locking discs, and stationary guiding members for guiding displacement of the locking discs, and wherein at least one of the locking discs is provided with a second gripping structure and is turnable about a first of said stationary guiding members between a position in which said one locking disc engages a second of said stationary guiding members and the second stationary guiding member prevents movement of said one locking disc in a direction opposite said opening direction and guides displacement of said one locking disc from the locked position to the open position, and a position in which the second gripping structure cooperates with the first gripping structure to prevent displacement of said one locking disc towards the open position.

2. A lock according to claim 1, wherein said one locking disc is spring loaded to the position in which said one locking disc engages the second stationary guiding member.

3. A lock according to claim 1, wherein the spring force that resists displacement of said one locking disc by the key urges said one locking disc to the position in which said one locking disc engages the second stationary guiding member.

4. A lock according to claim 1, wherein the gripping structure provided on said one locking disc comprises a first gripping structure and the stationary counter structure comprises a second gripping structure.

5. A lock according to claim 1, wherein the spring force that resists displacement of the locking discs by the key of the lock urges the locking discs toward a bottom region of the lock case, and the stationary counter structure is provided at the bottom region of the lock case.

6. A lock according to claim 1, wherein the second stationary guiding member guides displacement of the bolt relative to the lock case by the key of the lock.

7. A lock according to claim 1, wherein the lock case comprises a front plate formed with an opening through which the head of the bolt protrudes when the bolt is in the locking position, said one locking disc has an outer peripheral surface that engages the second stationary guiding member when the second stationary guiding member guides displacement of said one locking disc, the bolt is formed with a groove extending perpendicular to the front plate of the lock, and the second stationary guiding member comprises a pin that passes through the groove and guides displacement of the bolt relative to the lock case.

8. A lock according to claim 1, wherein the lock case comprises an elongate front plate formed with an opening through which the head of the bolt protrudes when the bolt is in the locking position, and the locking channel of said one locking disc is positioned at substantially the same location as at least one of the gripping structures relative to the longitudinal direction of the front plate.

9. A lock according to claim 1, wherein the lock case comprises an elongate front plate formed with an opening through which the head of the bolt protrudes when the bolt is in the locking position, at least one of the gripping structures extends over a range of positions in a direction parallel to the longitudinal direction of the front plate, and the locking channel of said one locking disc is positioned within said range of positions.

10. A lock according to claim 1, wherein the lock case includes guide means for guiding displacement of the bolt in predetermined first and second opposite directions and the locking pin is secured to the bolt and projects into the locking channels.

* * * * *